US005899379A

United States Patent [19]

Bruyn et al.

[11] Patent Number: 5,899,379

[45] Date of Patent: May 4, 1999

[54] INTERFACE STRIP FOR ROAD/RAIL CROSSING

[75] Inventors: Dominicus Bruyn, Cambridge; Frank Drayton Williams; Bill Wei Shiu Chien, both of Waterloo, all of Canada

[73] Assignee: Performance Polymers Inc., Cambridge, Canada

[21] Appl. No.: 08/958,700

[22] Filed: Oct. 27, 1997

[30] Foreign Application Priority Data

Oct. 28, 1996 [GB] United Kingdom ..... 9622428

[51] Int. Cl.[6] ..... E01C 9/04

[52] U.S. Cl. ..... 238/8

[58] Field of Search ..... 238/6, 8, 9

[56] References Cited

U.S. PATENT DOCUMENTS

| | | | |
|---|---|---|---|
| 4,461,421 | 7/1984 | Maass | 238/8 |
| 4,606,498 | 8/1986 | Grant et al. | 238/8 |
| 4,793,545 | 12/1988 | Raymond | 238/8 |
| 4,899,933 | 2/1990 | Martin | 238/8 |
| 5,577,662 | 11/1996 | Hogue et al. | 238/8 |
| 5,609,294 | 3/1997 | Lucas, Jr. | 238/8 |

OTHER PUBLICATIONS

Technical Bulletin (Epton) May 17, 1994.

*Primary Examiner*—S. Joseph Morano
*Attorney, Agent, or Firm*—Anthony Asquith & Co.

[57] ABSTRACT

At a road/rail crossing, rubber inserts are located alongside the rails, between the rail and the asphalt of the road. The insert has a resilient nose, which engages the under-face of the head of the rail. The insert does not touch the web of the rail, but rather the insert is wedged between the head and the flange of the rail. This engagement assists in locking the insert to the rail, by self-locking-taper action.

16 Claims, 7 Drawing Sheets

INTERFACE STRIP FOR ROAD/RAIL CROSSING

This invention relates to road/rail level crossings, and to the provision of elastomeric interface strips or inserts between the metal rails and the asphalt or other road surfacing material.

THE PRIOR ART

An example of a conventional type of interface inserts is Illustrated in U.S. Pat. No. 4,606,498 (Grant et al, 1986)

The Railseal End Retainer illustrated in the Epton Technical Bulletin, May 1994, is also relevant.

DETAILED DESCRIPTION OF PREFERRED EMBODIMENTS

By way of further explanation of the invention, exemplary embodiments of the invention will now be described with reference to the accompanying drawings, In which.

The apparatuses shown in the accompanying drawings and described below are examples which embody the invention. It should be noted that the scope of the invention is defined by the accompanying claims, and not necessarily by specific features of exemplary embodiments.

Figure 1:
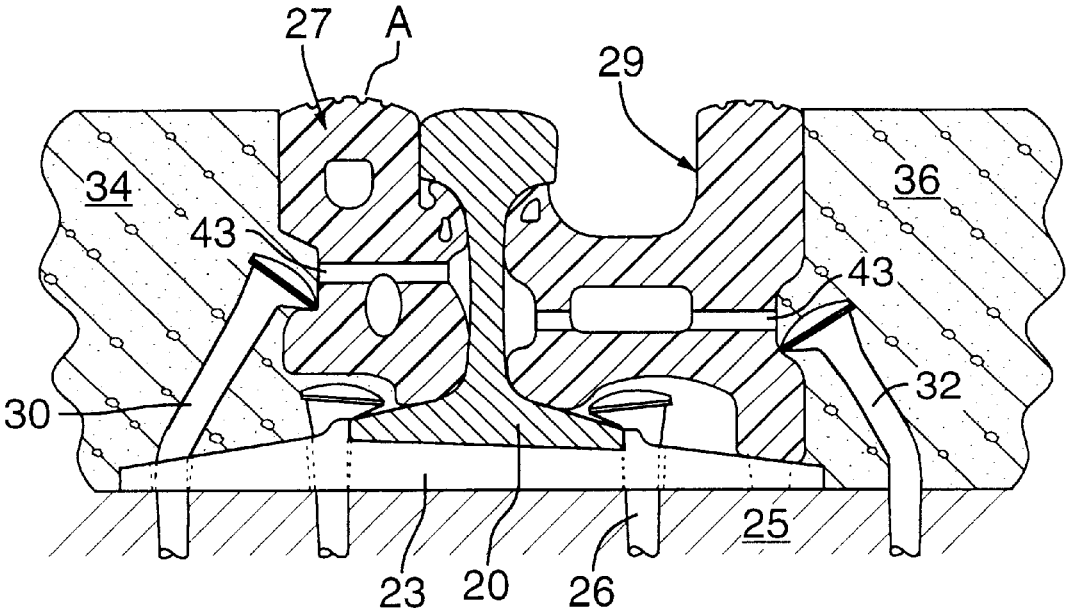
FIG. 1 is a cross-section of a railway rail, including a cross-tie, and showing respective elastomeric interface inserts either side of the rail.

As shown in FIG. 1, the (steel) rail 20 rests on a metal shoe 23, which in turn rests on the wooden cross-tie 25. In FIG. 1, the other rail of the railway track is to the right. In FIG. 1, the left side is termed the field-side, and the right side is termed the gauge-side.

The shoe 23 is held in place by the usual spikes 26 on the field- and gauge-sides.

Two interface inserts, a field insert 27 and a gauge insert 29, are laid either side of the rail 20. As in Grant et al, the inserts are held in place by respective bent-over spikes 30,32. The inserts are extruded in heavy, dense, hard, rubber. After installation of the inserts, asphalt or concrete 34,36 is poured and filled around the inserts, as shown, on both the field and gauge sides.

Figure 2:
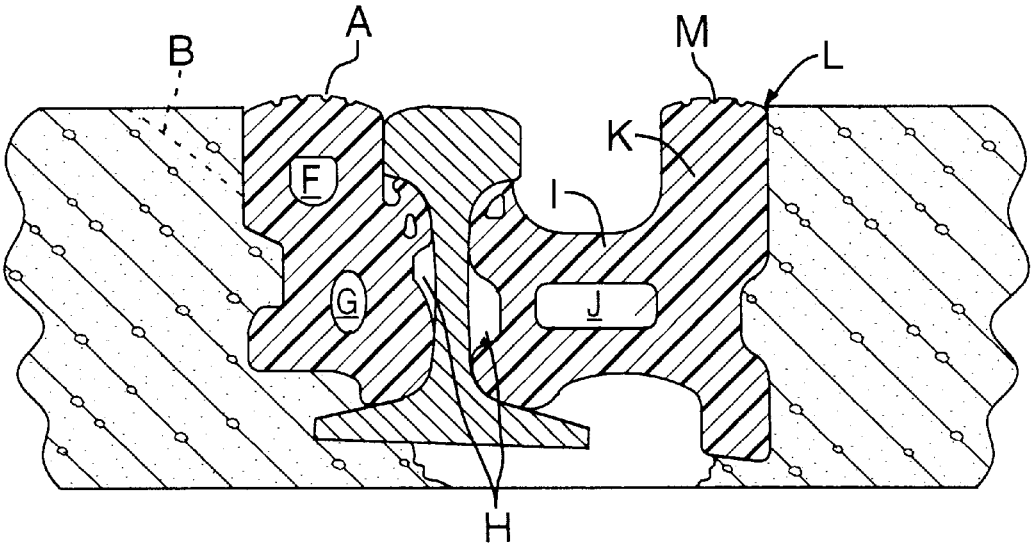
FIG. 2 is a corresponding cross-section taken further along the rail, between cross-ties.

FIG. 2 shows the configuration of the rail 20, inserts 27,29, and asphalt 34,36 in the area between the cross-ties. The asphalt rests on the usual ballast.

The profile of the field insert 27 includes the following features. The top surface A of the insert 27 is domed, and is installed so that the dome protrudes slightly above the level of the asphalt, and above the level of the rail. The protruding dome in fact serves to ease the bumping effect of being struck by the tire of a passing vehicle. The deflection of the dome of the (hard) rubber of the insert is enough to absorb some of the shock loading. When the asphalt starts to deteriorate, and crumble, generally this occurs first in region B (FIG. 2), i.e where the asphalt interfaces with the insert.

It may be noted that, when the rail 20 is deflected downwards by a passing train (and the deflection can be substantial), the insert tends to move downwards with the rail, whereas the asphalt substantially does not move. Thus, the asphalt at the interface is stressed, and tends to crumble after a period of time. However, even when the gap at B has become substantial, the shock of tires impacting the dome increases hardly at all, at least insofar as that shock is felt by the occupants of the vehicle. It may be regarded that the protruding dome A serves to ease the tires gently over the uneven surface.

It is important to prevent water, pebbles, etc, from entering the area C between the insert and the head of the rail. The face of the insert at C therefore should be pressed tightly against the metal of the rail head. The area D of the profile of the insert therefore should be clear of the rail: if this area D were to touch the rail, the face at C might be held clear.

The area E of the profile of the insert is compressed against, and seals against, the underside of the rail head, thereby preventing water from passing through. The profile is a tight fit between the rail head and the rail flange, whereby the seal at E is held firmly in place.

The cavities F and G in the profile serve to allow the rubber component to deflect somewhat, without damage, during operation, and also during assembly.

The profile of the gauge side insert 29 includes the following features.

Again, the profile is a tight fit between the rail head and the rail flange. The tight fit enables the insert to take support from the rail. This firm engagement to the rail during operation provides main structural stability for the insert. Also, the tight fit resists leaking of water between the insert and the rail. Both inserts have a cut out area H adjacent to the web of the rail, to give the profile some resilience in the vertical direction, between the head and the flange of the rail.

Sometimes, if debris has collected in the trough of the profile, a passing train wheel can cause the bridge area I of the profile to deflect downwards. The cavity at J means that if this happens the area K is not dragged to the left, thereby opening a gap at L. The section of the dome M should be thick and chunky also, to avoid opening the gap at L.

The undersurface of both inserts is relieved to provide room for the heads of the railfixing spikes (FIG. 1). The inserts themselves are held in place by the bent-over spikes, as shown. Rail clips vary in design. Certain other types of clips can be accommodated by the profile as shown, but in any case, the designer can easily ensure that the profile accommodates the particular clips.

Generally, the width of the road at a level crossing is, typically, 40 feet. Sometimes, the interface insert is needed in much longer lengths than that, for example when the railway runs longitudinally along the road. Above about 15 feet long, it becomes impractical to manufacture and transport the inserts to the crossing site economically in one piece. Indeed, for transport and installation of the inserts, a more convenient length is 8 feet, or less.

Therefore, it is necessary to join the lengths of the inserts together.

Figure 3:
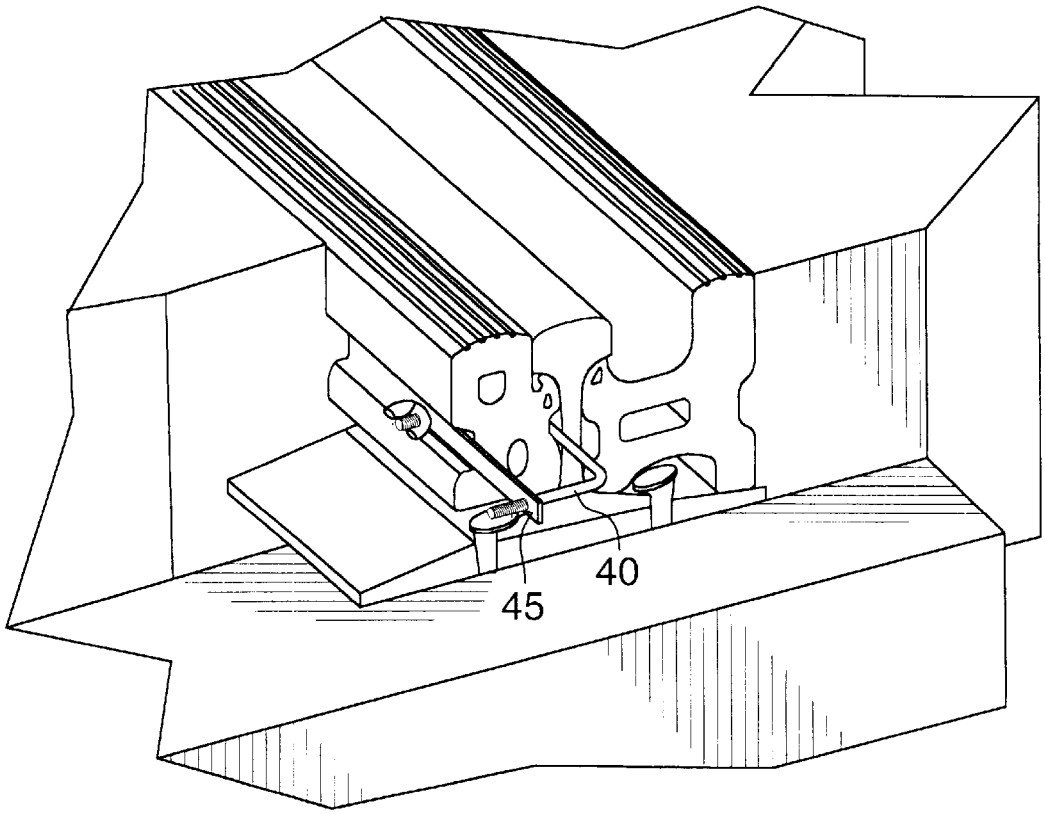
FIG. 3 is pictorial view showing a joint between two adjacent lengths of insert.

FIG. 3 shows a securement staple, of a type that has proved to be effective. The staples are intended to be secured in place during installation and assembly of the lengths of insert to the rail. After being taken down from the delivery truck, the inserts are positioned alongside the track. The U-shaped staple 40 is inserted into pre-drilled holes 43 (FIG. 1), thereby linking the adjacent lengths. A cross-bar 45 is then assembled to the protruding ends of the staple. The protruding ends are threaded, and nuts are placed thereon.

The nuts are then tightened. The squeezing of the rubber in the left-right direction, because of the tightening, causes some slight swelling in other directions, whereby the contact surfaces between adjacent sections are placed under a slight compression. The staple and the cross-bar reside in respective channels on the inside and outside of the profile. As a result, the combination of the staple, the cross-bar, the tightened threads, and the channels, is effective to make the joint firm and rigid, and yet the joint is simple and inexpensive to manufacture and install. The threads only extend a certain distance down the protruding ends, and therefore the nuts cannot be overtightened.

Using the staple design as shown, the inevitable bendings and twistings that occur during installation and assembly can be accommodated. Using the staple design as shown, also it is easy for the engineer, when the installation of the inserts is complete, to determine by a simple visual inspection that the staples are all properly present, and that all have been correctly tightened.

It may be noted that the same inside channels H in the profile of the inserts that were provided to make the fit to the rail resiliently secure, also serve to provide room for the staples. Similarly, the corresponding outer channels serve not only to provide room for the cross-bars and nuts, but serve also as a key for the asphalt, which is poured against the insert after installation.

Figure 4:
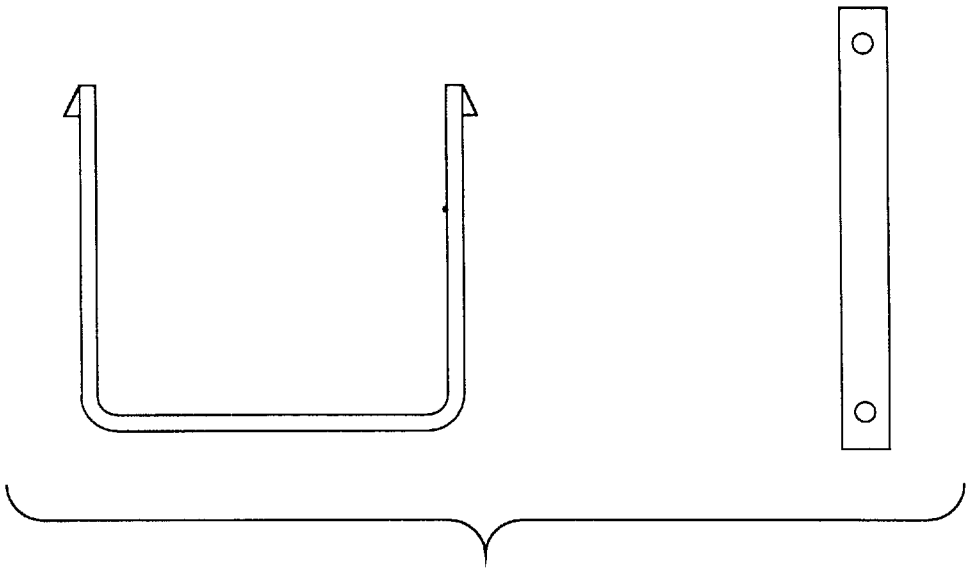
FIG. 4 is a view of a securement staple.

It may be noted that installation has to be carried out quickly, because, of course, the road has to be closed to traffic during installation, and often the railway has to be closed also. FIG. 4 shows a different staple assembly, in which the cross-bar can be slipped over the protruding ends of the U-shaped staple, with a minimum of skill and labour.

Figure 5:
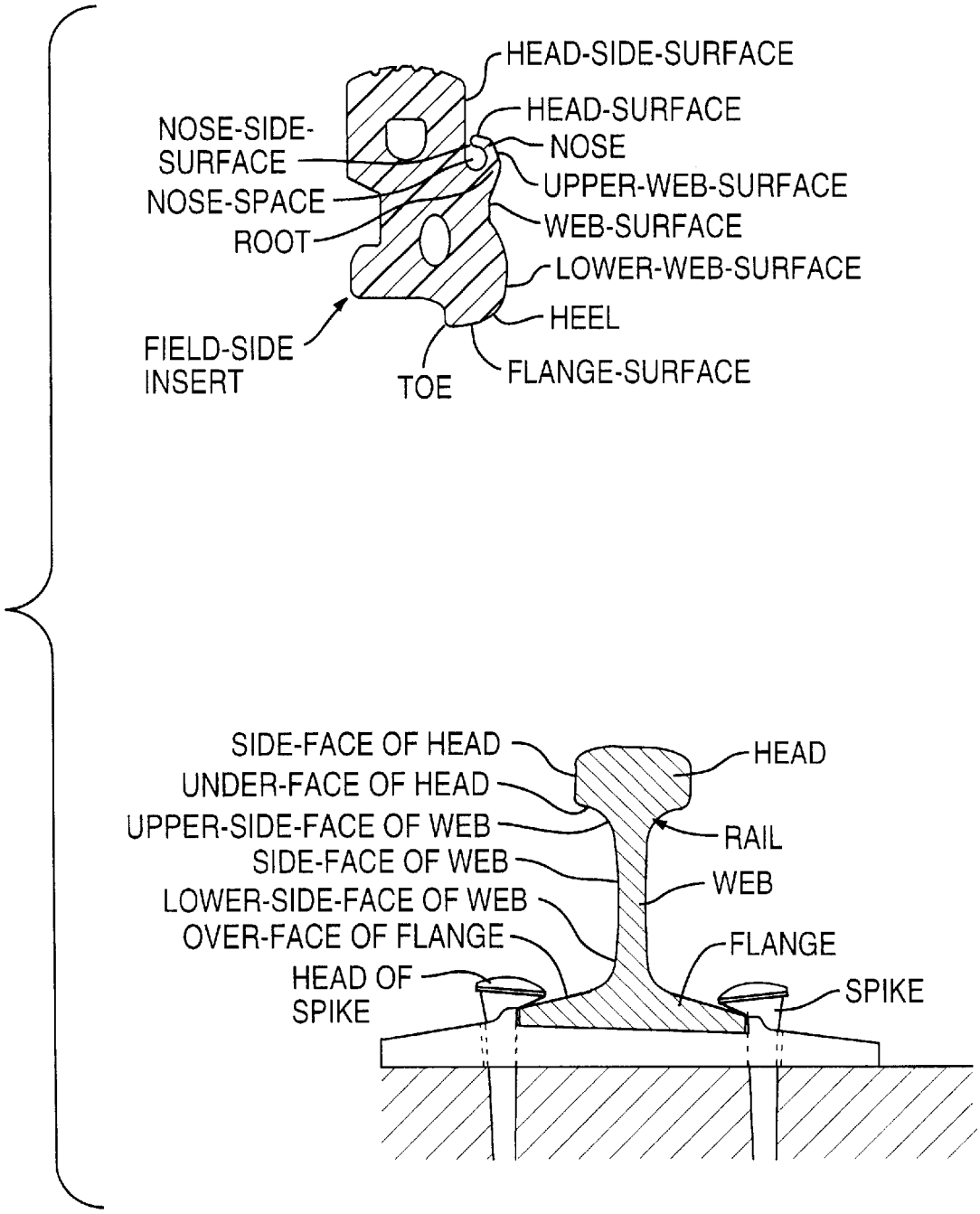
FIG. 5 is a view corresponding to FIG. 1 of another insert assembly.

The manner in which the insert is held in place against the rail will now be described in more detail. FIG. 5 illustrates the terminology used herein for the various areas of the rail and insert.

Figure 6:
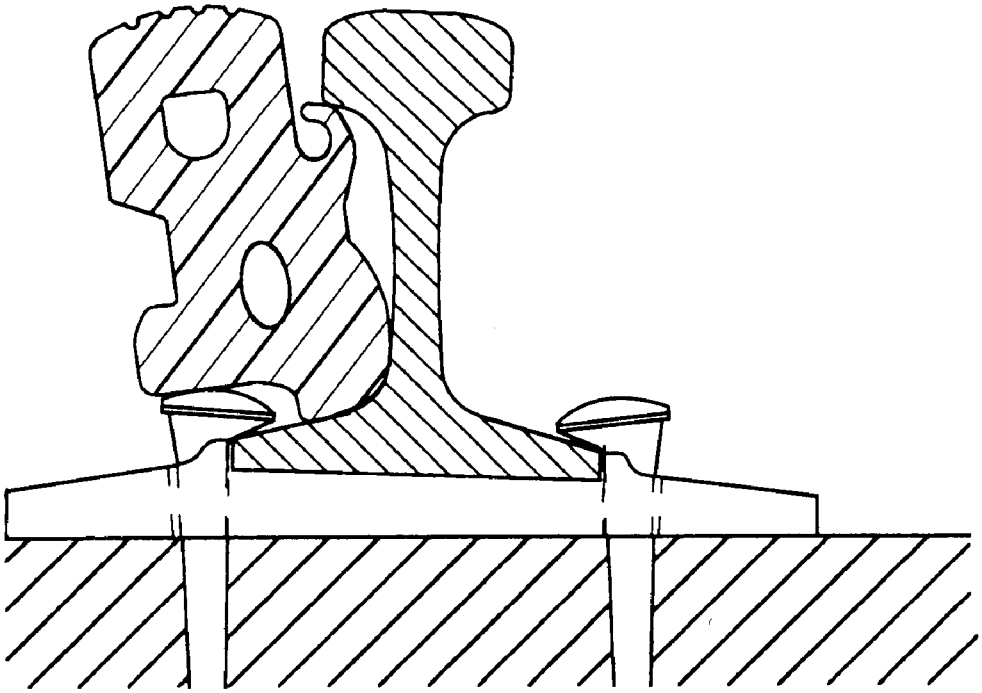
FIG. 6 is a view corresponding to FIG. 5, showing some of the components at a preliminary stage of installation.
Figure 7:
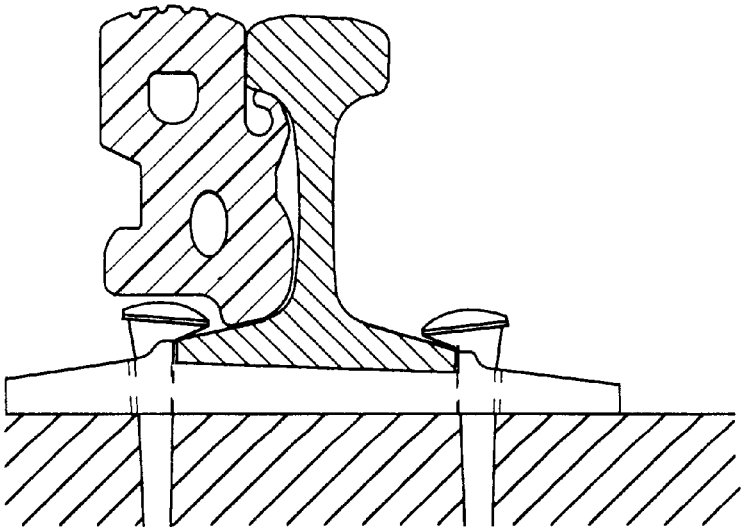
FIG. 7 is a view corresponding to FIG. 6, showing another stage of installation.

As shown In FIG. 6, the rubber insert is installed into the field side of the rail, by first placing the heel of the insert against the lower-side-face of the web of the rail. As shown in FIG. 6, the nose of the insert has just started to enter underneath the underface of the head of the rail. It will be noted that the insert, at this time, is somewhat rotated as compared with its final installed position (FIG. 7). In fact, it turns out that, at the start of the installation procedure, the insert is rarely in any configuration other than that shown in FIG. 6 (e.g straight up). The operation is carried out at ground level, by operatives who are standing on the ground, and the inserts just seem naturally to adopt the rotated configuration.

Next, the insert is urged to the right. This is done preferably by the operative kicking the insert. If the operative were to use a sledge hammer, there is a (remote) possibility that he might miss the insert and strike the rail directly with the hammer, which could damage the rail. Similarly, if he uses a crow-bar, the crow bar would have to pry against either the rail itself, or the pebbles of the ballast, or against the wood of the cross-tie, all of which are unsatisfactory from the standpoint of controlling the application of heavy force against the insert, and from the standpoint of damaging the railway structure. But not even the most clumsy operative can damage railway components by kicking them.

As the insert moves to the right, the head-surface of the nose makes contact with the under-face of the head, at a contact patch. There is a nose-space between the nose-side surface and the head-side-surface, and the nose-side surface is undercut, near to the root of the nose. Because of this configuration, if the nose is subjected to a leftwards force at its tip, the nose is able to bend to the left, cantilever fashion. On the other hand, if the nose were subjected to a rightwards force at its tip, the nose would not tend to bend to the right, but rather would tend to be subjected to simple compression, like a column. Friction at the contact patch between the head-surface of the nose and the under-face of the head, as the nose moves to the right, thus causes the nose to bend to the left. When the insert is being forced to the right, as the nose bends (slightly), the contact force is (slightly) reduced, whereby the nose easily slips progressively further under the under-face as the nose is forced to the right.

On the other hand, if the insert were subjected to a force tending to urge the insert to the left, a motion to the left would be resisted more strongly. That is to say, if the nose were to try to move to the left, the friction at the contact patch would urge the nose to bend to the right. This it cannot do, because of the shape of the nose. That is to say, the nose would tend to dig itself more tightly into the under-face, if the insert were urged to the left. Thus, the configuration of the nose allows the nose, in a sense, to ratchet itself progressively into position underneath the under-face of the head, as the insert is subjected to repeated kicks. Of course, it cannot be expected that every kick applied by the operatives will be well-aimed. But it is noted that a couple of well-directed kicks will suffice to drive the insert fully home, whereas even if the well-directed kicks are many in number, such kicks are unlikely to dislodge the insert.

Of course, it is not suggested that kicking the insert in is the only possible manner of installation: but rather, that the design of the nose, as depicted, permits the zero-tool, kicking-the-insert-in, manner of installation to be contemplated.

It is recognised that, in order for kicking-the-insert-in to be effective as a manner of installing the Insert, the Insert, when kicked, should remain where it is kicked, and should not bounce back from the rail. It is recognised also that succeeding kicks should result in a progressive deepening of the engagement of the insert into the rail, rather than the kicks being a case of one lucky hit happening to drive the insert to the correct location. The nose configuration, as depicted, ensures this progressive aspect to the entry of the insert into the rail.

The designer should set the dimensions of the nose area of the insert so that the head-side-surface of the insert reaches the side-face of the head of the rail before the upper-web-surface of the insert reaches the upper-side-face of the web of the rail. As shown in FIG. 7, when the insert is fully home, there is a space between the upper-web-surface of the insert and the upper-side-face of the rail.

As mentioned, at first during installation, it can be expected that there will be touching contact between the heel of the lower-web-surface of the insert and the lower-side-surface of the web of the rail (FIG. 6). However, as the upper end of the insert is driven to the right, the insert rotates clockwise, and therefore the contact point between the heel and the rail moves downwards. Similarly, the contact point between the toe of the flange-surface and the over-face of the flange moves to the left. It will be noted that as these motions take place, the heel and toe do not tend to "dig into" the metal faces, but rather, because of the shapes of the faces, as slippage of the heel and toe occurs, further movement of the heel and toe becomes easier. In fact, often what happens is that as the insert moves in, it slips around in jerks, i.e the insert moves from the FIG. 6 position to the FIG. 7 position in one jerk.

It will be noted that the clockwise rotation of the insert during Installation of course involves the lower areas of the insert being moved to the left, even though the insert is being kicked to the right. Also, the fact that a space opens up between the lower-web-surface of the insert and the lower-side-face of the rail (FIG. 7) also Is a manifestation of the movement of the lower part of the insert in the leftwards direction. The reason this leftwards movement of the lower portion of the insert can take place, and can take place under control, can be explained as follows.

As mentioned, when slippage of the toe of the insert leftwards along the over-face of the flange takes place, the configuration of the contact between the insert and the rail means that further slippage of the toe along the over-face now will be a little easier. That is to say, once leftwards-slippage of the toe commences, it will tend to continue. Similarly, slippage of the heel down the lower-side-face, once started, will tend to continue. However, once the heel touches the over-face of the flange, the situation changes. Now, if any further rotation of the insert were to take place, the toe of the insert would actually have to start to break contact with the over-face of the flange. Therefore, although rotation of the Insert to the FIG. 7 position could take place fairly easily, further rotation of the insert beyond the FIG. 7 position is greatly resisted.

In fact, the stable equilibrium of the insert when in the FIG. 7 position may be noted. In FIG. 6 the heel was not touching the flange, and when the nose was pressing upwards against the under-face of the head, the reaction to that force was provided at the contact between the toe and the flange. The lines of action of the (vertical) vectors of these two forces thus gave rise to a couple in the sense tending to rotate the insert clockwise. Thus, before the heel touches the over-face of the flange (FIG. 6), there are only two vertical forces acting on the insert, ie the force from the nose pushing upwards against the rail head, and the force from the toe pushing downwards on the flange, and the couple caused by the fact that the lines of action of these two forces are spaced apart horizontally, serves to encourage the clockwise rotation of the insert.

But when the heel touches the over-face of the flange, now there are three vertical forces on the Insert, and the couple urging the insert to turn clockwise disappears. In fact, if the clockwise movement of the insert were to continue, the toe would break contact; and now the vertical force at the nose would be reacted by a force acting through the heel, and the resulting couple would tend to make the insert rotate now counter-clockwise. Thus, continued rotation of the insert beyond the FIG. 7 condition is greatly resisted. Once the toe and heel both touch the over-face of the flange, the insert now resists, in a very stable manner, and further tendency for it to rotate. In fact, it has been found, in cases where for some reason it was desired to remove an installed insert, that taking the insert out can indeed be very difficult, even though the insert was only lightly kicked into place.

Another benefit arises from the fact that the insert is so stable in the FIG. 7 position, which may be described as follows. It has been observed that, in many cases, once the insert starts to rotate clockwise, the movement to the FIG. 7 position is accomplished in a jerk or snap. That is to say, the preliminary position shown In FIG. 6 is unstable, whereas the final position shown in FIG. 7 is stable. Often, the clockwise jerk takes place just after the insert has been moved to the right far enough for a lower portion of the head-side-surface to make contact with the transition between the side-face of the head of the rail and the under-face of the head. Now, a kick to the top of the insert will give rise to a clockwise couple, as the insert pivots about that point of contact, which is enough to initiate the jerk to FIG. 7. The benefit that happens in that case is that, as the toe and heel snap to the FIG. 7 position at a time when contact between the head-side-surface and the side-face has already started, the head-side-surface of the rubber becomes pressed more tightly against the side-face of the head of the rail.

That is to say, a contact force remains locked in by the stability of the FIG. 7 position, whereby the head-side-surface of the rubber is actually being pressed against the side-face of the head. This point should be stressed, that even though the rubber insert is simply kicked against the rail, during installation, the insert, far from bouncing back clear of the side of the head of the rail, actually ends up being pressed tightly against the side of the head. It is not suggested that it can be guaranteed that just any casual kick of the insert will leave the rubber pressed tightly against the rail head, but on the other hand it does not take much care or skill on the part of the operative to leave the insert in that advantageous condition.

It will be noted that the just-described advantageous condition arises because the head-side-surface of the insert can come into contact with the side-face of the head, before the upper-web-surface of the insert can come into contact with the upper-side-face of the web. Also, the condition arises because of the configuration of the nose, which greatly resists any tendency of the head-surface of the insert to move to the left, while permitting relatively easy movement of the head-surface to the right.

Thus, the detailed shape of the insert has a substantial effect on the manner in which the profile of the insert moves bodily and rotates during installation, and on the stability with which the insert settles to its final installed position.

The following point also should be noted. The resilent nose comprises a lip seal, whereby moisture is prevented from leaking down between the insert and the rail, below the nose.

The following points also should be noted. The under-face of the head of the rail and the over-face of the flange define an included angle. This angle is about 25 degrees. (The actual angle varies with the different designs of rail profile, but a 25 degrees include angle is typical.)

As is well-known, wedge action, or self-looking taper acting, can occur when a tapered male component is inserted into a correspondingly-tapered female component. It is a matter of text book mechanics that whether the self-locking action is present depends on whether the tangent of the included angle of the taper is less than the coefficient of friction between the mating components. The tangent of 25 degrees is 0.47; therefore, the angle between the under-face of the head and the over-face of the flange can give rise to a self-locking-taper action provided the coefficient of friction between the rail and the insert is more than 0.47. Now, rubber on metal can indeed have a coefficient of friction of that magnitude. In fact, so long as the interface is dry and clean, the coefficient of friction of rubber on steel can be expected to be higher than 0.47. Therefore, a self-locking-taper effect can exist between the insert and the rail, whereby the insert retains itself in the rail, once it has been pushed into place: according to self-locking-taper theory, it should take (almost) as much force to dislodge the insert from the taper as it took to insert it.

In order for the self-locking-taper condition to exist, the designer should see to it that the insert touches the rail only at the contact points (a) between the head-surface of the insert and the under-face of the head, and (b) between the flange-surface of the should not be allowed to reach the side-face of the web, because then the self-locking-taper effect caused by wedging the insert between the angled faces would be lost.

As will be noted from FIG. 7, this required condition for self-locking-taper action, i.e that the web-surface of the insert be clear of the side-face of the web, is present in the depicted design. Thus, another reason why the depicted profile of the insert results in the insert being held so securely against the rail is that the insert is wedged between the head and the flange, and is held there by self-locking-taper action.

The fact that the nose is more resilient than the bulk of the profile of the insert does not take away from the ability of the insert to undergo a self-locking-taper action. The designer should see to it that the resilience in the nose is not so great as to permit the insert to move so far to the right that the web-surface of the insert touches the side-face of the web, which would curtail the self-locking-taper effect.

It has been the common practice for rubber inserts at road/rail crossings to be retained in place by supplementary spikes. The use of such spikes is generally seen as highly disadvantageous, and to be avoided if possible. However, the need is very pressing to make sure the insert does not move while the asphalt or concrete is being poured or installed. It is noted that the main function of the supplementary spikes is to hold the rubber in place, and ensure the insert does not become dislodged, during the time while the asphalt or concrete of the roadway is being put in place. Once the asphalt or concrete is in place, the insert is retained thereby, and the supplementary spikes are no longer needed. Thus, the vulnerability of the cross-tie to long-term deterioration caused by driving in the supplementary spikes is all the more frustrating because the spikes serve such a short-term function.

Other approaches to holding the inserts in place while the roadway surface is being applied have involved the use of clips. Here, a spring-steel clip is of a U-shape; the bridge of the clip straddles the rail (underneath) and the arms of the clip squeeze the inserts against the sides of the rail. The use of such clips, apart from the direct expense thereof, can be disadvantageous because of the need to insert the clips underneath the rail, which might mean disturbing the ballast, and subsequently involving the railway authorities in a tiresome re-check of the ballast, and because special tools are usually needed, depending on the design of the clip, for installation thereof. Installing rubber inserts at road/rail crossings is carried out by non-specialist contractors, usually, for whom the provision of special tools for installing the clips is disadvantageous.

Besides, speed of installation is important, because the crossing has to be closed, at least to road traffic if not to rail traffic, for at least several hours, while installation is taking place. If simply kicking the inserts into place can be relied on as an installation method, that has great advantages, as compared with the use of supplementary spikes or clips. On the other hand, of course it is not suggested that clips and spikes cannot be used with inserts of the types as depicted herein.

The notion of kicking the insert into place has been described above as it applies to the insert that fits the field-side of the rail. However, difficult as the problem might be of retaining the field-side insert without clips or spikes, the problem of retaining the gauge-side inserts is many times worse.

Figure 8:
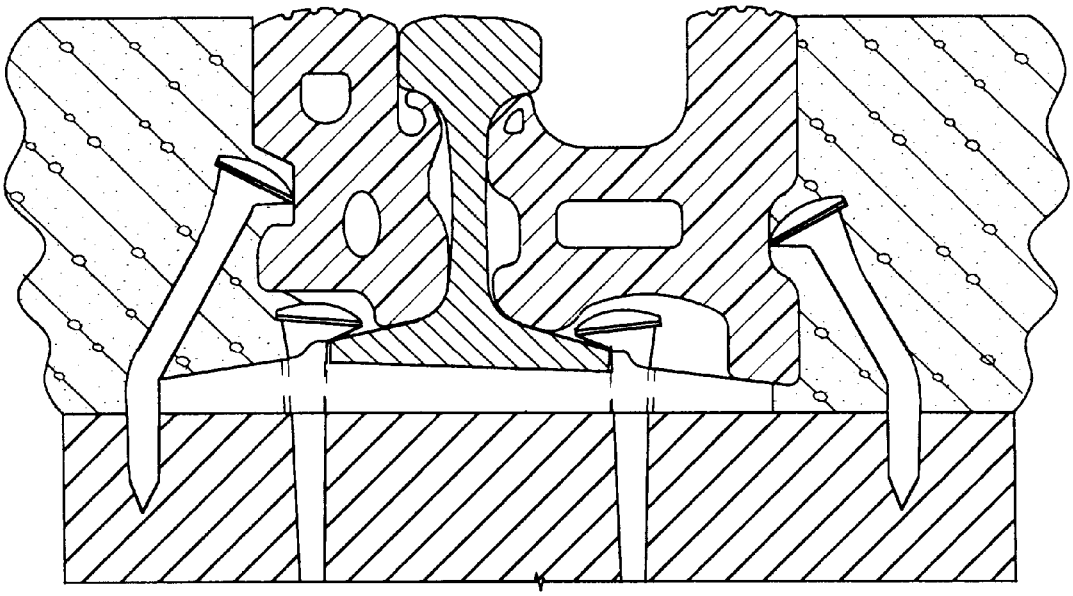
FIG. 8 is a view corresponding to FIG. 1 of another insert assembly.

The gauge-side inserts must provide deep cut-outs in their profiles, for accommodating the flanges of the passing railway wheels, and the designer finds, generally, that every other aspect of the design of the profile must be compromised, in order to accommodate these deep flange cut-outs. The gauge-side insert is laterally much wider than the field-side insert (FIG. 8), so that generally the gauge-side insert cannot simply rest on top of the flange of the rail, but rather the gauge-side insert must rest on the cross-ties, or at least on the shoes or tie-plates that rest on the cross-ties. As a result, portions of the length of the gauge-side insert between the cross-ties tend to sag or hang down, during installation. Furthermore, during on-going operational use, the gauge-side insert is less stably retained by the material of the roadway, in that there is a tendency of the insert to roll over due to the actions of heavy road vehicles.

Thus, the use of spikes or clips to hold the insert is more critical in the case of the gauge-side insert than the field-side insert. Providing an insert-profile that wedges itself to the rail on the field-side of the rail has proved, as described herein, to be a solvable problem, but the corresponding problem on the gauge-side of the rail has been less amenable.

However, even though the interaction per se between the rail and the insert does not seem to be able to provide adequate retention of the insert on the gauge-side, it is recognised that the gauge-side of the rails has another available avenue for providing a means for retaining the gauge-side inserts against the rails, and that is the space between the rails. This space is available for accommodating a structure which can straddle across between the two rails, and which can exert a force pressing the gauge-side inserts against the gauge-sides of the rails. That is to say, in respect of the inserts on the gauge-sides of the left and right rails, the left rail can provide a means for reacting a force which loads the right gauge-side insert against the right rail, and vice versa (i.e the right rail can provide a means for reacting a force which loads the left gauge-side insert against the left rail).

Figure 9:
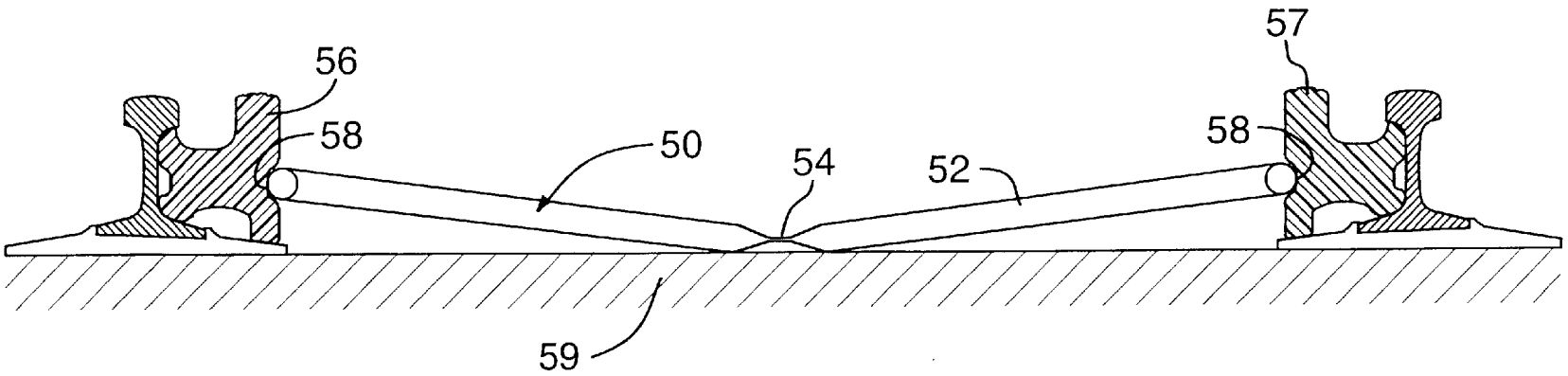
FIG. 9 is a cross-section of a railway track, showing the use of a cross-bar for installation of gauge-side inserts.
Figure 10:
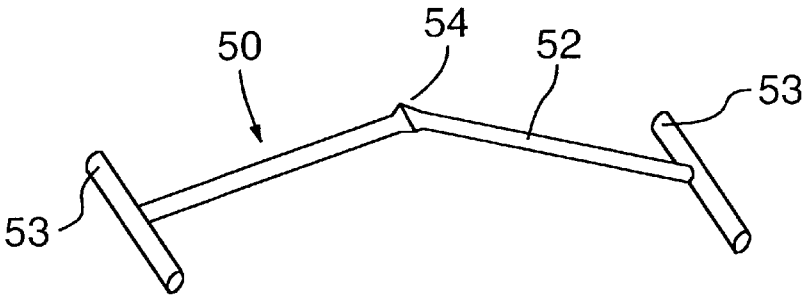
FIG. 10 is a view of a cross-bar, as used in FIG. 9.

FIG. 9 shows how this reaction between the left and right rails can be utilised to provide a means for loading the inserts against the gauge-sides of the rails. A cross-bar 50 (FIG. 10) is provided for the purpose. The cross-bar comprises a length 52 of steel tubing. T-bars 53 are welded perpendicularly one at each end. The tubing 52 is creased in the middle, at 54, by squeezing the walls of the tube together.

The cross-bar 50 is installed as shown in FIG. 9. The operatives place the left and right gauge-side inserts 56,57 in position against the left and right rails. The operatives place the inserts as tightly as possible against the rails (e.g by hammering or kicking the inserts against the rails). However, experience has shown that the gauge-side inserts cannot be relied on to remain in place throughout the assembly and installation of the inserts, and the subsequent pouring of the asphalt or concrete. In previous systems, the operatives have had to drive spikes into the ties, to hold the inserts in place. In the FIG. 9 system, the operative bends the cross-bar 50 slightly, which is easy enough because of the crease 54, whereupon the operative can then place the T-bars 53 in the grooves 58 provided in the inserts. The operative places the bent cross-bar with the crease 54 uppermost. Next, he simply stands on the creased area. His weight serves to straighten the cross-bar, in an action which forces the left and right inserts simultaneously against their rails. The geometry of the grooves 58 with respect to the ties 59 is such that the cross-bar can go over-centre, and thereby become locked in position (FIG. 9).

The cross-bars 50 are provided at the rate of one per tie, for example, or as required.

The design of the cross-bars makes it easy for the contractor to determine that the cross-bars, and the gauge-side inserts, have been correctly installed. In respect of the field-side inserts, it is an easy matter for the contractor to view the field-side inserts after installation, and to see that the field-side inserts lie close against the head of the rail, all along the length of the inserts. But in respect of the gauge-side inserts, such inspection is not so easy. The presence of the large flange cut-out gap makes means that the eye cannot so readily determine whether the gauge-side insert is fully home. But the cross-bars make inspection of the gauge-side also very easy. If one of the cross-bars has to be bent too much at the crease in order to get it started between the inserts, that indicates that the inserts are not fully home, and need to be driven in further. Also, after assembly of the cross-bars, they should all look the same; if one lies at a different angle from the others, that fact is easily picked up, and indicates that the inserts are not fully home at that point. It is noted that inspection does need to be easy, and quick: because the "evidence" will be buried in the road, the contractor can be tempted to skimp on the details of installation if they present difficulties.

It will be understood that the cross-bar as described can be installed without special tools, and indeed without any tools at all. This aspect is in line with what is required for assembling the field-side inserts, in which, as described, the inserts can be locked adequately to the rails during installation simply by kicking (or hammering) the field side insert against the rail. It is recognised that providing a system for simplifying the retention of the field-side inserts makes most practical sense when a system for simplifying the retention of the gauge-side inserts, being a system that is very similar to operate, is also provided. If no clips are needed for the field-side, it would be a pity to have to provide the clips after all for the gauge-side, and this is avoided by the use of the crossbar as described.

Figure 11:
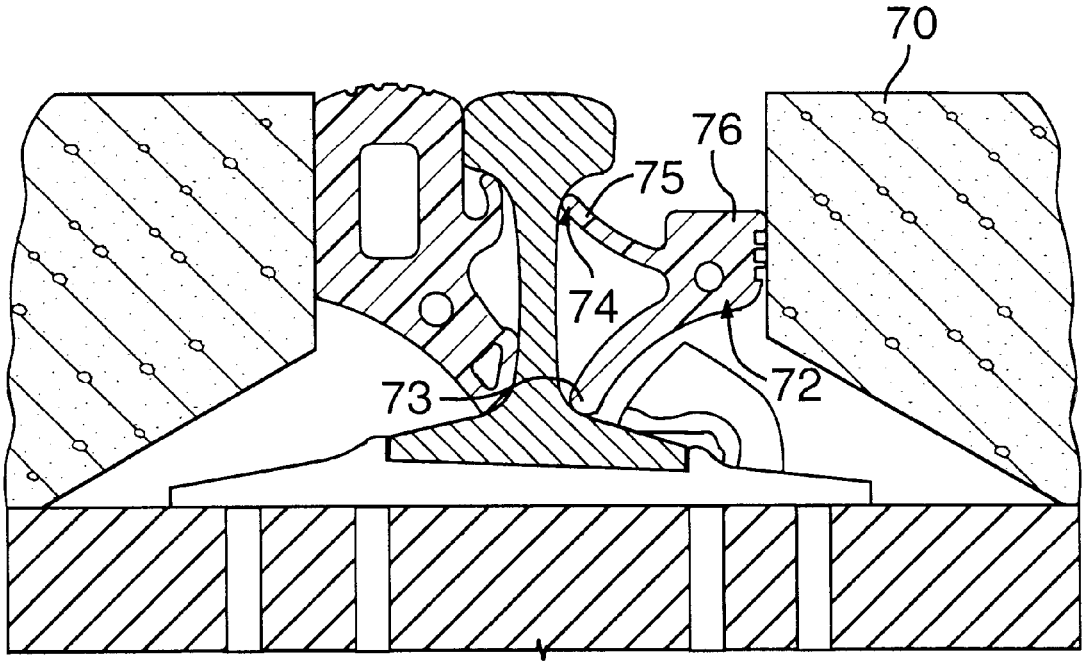
FIG. 11 is a cross-section of another railway rail, with inserts.

FIG. 11 shows another type of installation. Here, the portion of the roadway that lies between the rails is formed as a pre-cast concrete block 70. The gauge-side insert 72 is installed after the concrete block has been put in place. Installation proceeds as follows. First, the insert is installed by lowering the leg 73 of the insert into the space between the rail and the block 70. Then, the rest of the insert is lowered into the space, until the tip 74 of the nose 75 is resting against the top of the head (at which point the leg 73 is is about half-way down the web of the rail). Next, the main body 76 is pressed down, until the leg 73 contacts the over-face of the flange, at which point the insert greatly resists any further downwards pressure. At this point, the nose 75 lies against the side-face of the head, with the tip 74 pointing upwards. Now, the operative uses a crow-bar or similar tool to prise the tip of the nose underneath the head of the rail. The final resting position of the insert is as shown In FIG. 11.

We claim:

1. An insert apparatus for a road-rail crossing, wherein:

the crossing includes left and right rails, and a road made of a material;

the apparatus includes an insert, of elastomeric material, and of constant cross-sectional profile along its length;

in respect of one of the rails:

the insert is arranged for placement lengthwise alongside the rail, between the rail and the material of the road;

the rail has a head, a web, and a flange;

the head of the rail has a downwards-facing under-face, and the bottom flange of the rail has an upwards-facing over-face;

the under-face and the over-face are so positioned and angled as to define a wedge angle included therebetween;

the cross-sectional profile of the insert includes a head-surface, which is complementary to the under-face of the rail-head;

the cross-sectional profile of the insert includes a flange-surface, which is complementary to the over-face of the rail-flange;

the cross-sectional profile of the insert is so proportioned that, when the insert has been placed lengthwise alongside the rail, and has been pressed into contact with the rail, the insert can lie tightly wedged between the head and the flange of the rail;

in that the profile of the insert lies substantially clear of the web of the rail, and in that the head-surface of the insert lies tight against the under-face of the rail-head, and simultaneously the flange-surface of the insert lies tight against the over-face of the rail-flange;

the proportions of the cross-sectional profile of the insert are such that the insert can be so tightly wedged between the head and the flange of the rail that the insert is thereby self-sustaining, in that the insert holds itself in place against the rail, prior to the material being put in place.

2. Apparatus of claim 1, wherein the insert is on the field-side of the rail.

3. Apparatus of claim 2, wherein:

the head of the rail has a side-face, and the web of the rail has an upper-side-face;

the insert has a head-side-surface, and an upper-web-surface;

the profile of the insert is so configured, in relation to the rail, that, with the head-side-surface of the insert in contact with the side-face of the head of the rail, the upper-web-surface of the insert lies substantially clear of, and spaced from, the upper-side-face of the web.

4. Apparatus of claim 1, wherein the insert is wedged in, and is held by self-locking-taper action, due to wedge contact, in that:

the insert is so shaped that, upon the insert being inserted between the head and the flange, and pushed towards the web:

the head-surface of the insert engages with, and pushes with a force vertically up against the under-face of the head;

and the flange-surface of the insert makes direct touching contact with, and pushes with a force down against, the over-face of the flange;

the configurations of the insert and the rail at the engagements is such that the engagements give rise to friction forces respectively between the surfaces of the insert and the corresponding faces of the rail, which resist movement of the insert out of contact with the rail.

5. Apparatus of claim 1, wherein an uppermost surface of the insert, being the surface of the insert which is contacted by the tires of vehicles passing over the crossing, is domed.

6. Apparatus of claim 1, wherein the insert profile includes a groove on a web-surface thereof, for accommodating an end-to-end-joint clip;

the insert includes lateral through-holes for receiving the clip;

and two of the inserts lie joined together end-to-end, being held together by a joint-clip that lies in the groove.

7. An insert apparatus for a road-rail crossing, wherein:

the crossing includes left and right rails, and a road made of a material;

the apparatus includes an insert, of elastomeric material, and of constant cross-sectional profile along its length;

in respect of one of the rails;

the insert is arranged for placement lengthwise alongside the rail, between the rail between the rail and the material of the road;

the rail has a head, a web, and a flange;

the head of the rail has a downwards-facing under-face, and the bottom flange of the rail has an upwards-facing over-face;

the cross-sectional profile of the insert includes a head-surface, which is complementary to the under-face of the rail-head;

the cross-sectional profile of the insert includes a flange-surface, which is complementary to the over-face of the rail-flange;

the cross-sectional profile of the insert includes a relatively resilient nose;

the nose has an upper tip, and a root;

the head-surface of the profile comprises a head-surface of the nose, on the upper tip thereof;

the nose has a degree of leftwards sloping configuration, in that, with the insert lying to the left of the rail, the upper tip of the nose lies to the left of the root;

the degree of leftward slope of the nose is such that, with the insert lying between the over-face and the under-face, when the head-surface of the insert is urged to the right the nose is able to deflect predominantly in the manner of a cantilever in bending, and when the head-surface is urged to the left the nose is able to deflect predominantly in the manner of a column in compression.

8. Apparatus of claim 7, wherein:

the sloping configuration of the nose is such that:

with the insert lying to the left of the rail, and lying between the over-face and the under-face;

with the head-surface of the nose forming a contact-patch with the under-face of the head of the rail, whereby friction opposes movement of the head-surface along the under-face, thereby giving rise to a friction drag force vector parallel to the under-face, and a normal reaction force vector acting at the centre of the contact patch and perpendicular to the under-face, which are resolved to a resultant force vector, having a line of action;

the line of action of the resultant force vector falls well to the left of the root of the nose when the upper-surface of the insert is urged to move to the right, and falls within, or falls close to, the root when the upper-surface is urged to move to the left.

9. Apparatus of claim 8, wherein the profile of the insert is so configured as to include a nose-space between a nose-side-surface of the nose and a head-side-surface of the insert;

and the nose-side-surface is undercut.

10. Apparatus of claim 8, wherein:

the flange-surface of the insert has a heel and a toe;

the heel is the portion of the flange-surface that lies close to the web of the rail;

the flange-surface is long in that the heel and toe of the flange surface are well-spaced-apart;

and the heel lies on a vertical line to the right of, and the toe lies on a vertical line to the left of, the centre of the contact patch.

11. Apparatus of claim 10, wherein:

the rail is held in place on a cross-tie by means of a spike, and the head of the spike engages a portion of the over-face of the flange of the rail;

and the insert is so configured that the toe of the flange-surface of the insert lies to the right of, and clear of, the head of the spike.

12. Apparatus of claim 7, wherein the head-surface of the nose comprises a lip-seal, for engagement with the under-face of the head of the rail.

13. Apparatus of claim 7, wherein:

in respect of a field-side of the rail, the head of the rail has a side-face, and the web of the rail has an upper-side-face;

in respect of the insert on the field-side of the rail, the insert has a head-side-surface, and an upper-web-surface;

the profile of the insert is so configured, in relation to the rail, that, with the head-side-surface of the insert in contact with the side-face of the head of the rail, the upper-web-surface of the insert lies substantially clear of, and spaced from, the upper-side-face of the web.

14. An insert apparatus for a road-rail crossing, wherein:

the crossing includes left and right rails, and the apparatus includes left and right gauge-side inserts;

in respect of each of the gauge-side inserts:

the insert is of elastomeric material, and is of constant cross-sectional profile along its length;

the insert is arranged for placement lengthwise alongside the respective rail, between the rail and the material of the road;

in respect of both the left and right gauge-side inserts, the apparatus includes a means for applying a side force thereto;

the said means includes a cross-bars, which straddles the distance between the left and right gauge-side inserts;

the cross-bar comprises a means for pressing the gauge-side inserts tightly against the gauge-sides of the respective rails;

and the apparatus includes means for locking the cross-bar in place between the rails.

15. Apparatus of claim 14, wherein the cross-bar comprises a length of tubing, and the means for locking the cross-bar comprises a crease in the tubing, located at an intermediate point along its length, whereby the tubing can bend at the crease and adopt an over-centre locking condition between the rails.

16. Apparatus of claim 14, wherein:

in respect of each of the rails:

the rail has a head, a web, and a flange;

the head of the rail has a downwards-facing under-face, and the bottom flange of the rail has an upwards-facing over-face;

the apparatus includes left and right field-side inserts, and in respect of each of the field-side inserts;

the insert is of elastomeric material, and is of constant cross-sectional profile along its length;

the insert is arranged for placement lengthwise alongside the respective rail, between the rail and the material of the road;

the cross-sectional profile of the insert includes a head-surface, which is complementary to the under-face of the rail-head;

the cross-sectional profile of the insert includes a flange-surface, which is complementary to the over-face of the rail-flange;

the proportions of the cross-sectional profile of the insert are such that the insert can be so tightly wedged between the head and the flange of the rail that the insert is thereby self-sustaining, in that the field-side insert holds itself in place against the rail, prior to the roadway material being put in place.

* * * * *